US005602925A

United States Patent [19]

Killion

[11] Patent Number: 5,602,925

[45] Date of Patent: Feb. 11, 1997

[54] HEARING AID WITH PROGRAMMABLE RESISTOR

[75] Inventor: Mead C. Killion, Elk Grove Village, Ill.

[73] Assignee: Etymotic Research, Inc., Elk Grove Village, Ill.

[21] Appl. No.: 381,539

[22] Filed: Jan. 31, 1995

[51] Int. Cl.[6] ..... H04R 25/00

[52] U.S. Cl. ..... 381/68.4; 381/68; 330/284

[58] Field of Search ..... 381/68, 68.2, 68.4, 381/102, 103, 104, 106, 109, 98; 330/284, 144, 145; 333/81 R; 327/306

[56] References Cited

U.S. PATENT DOCUMENTS

| | | | |
|---|---|---|---|
| 4,882,762 | 11/1989 | Waldhauer | 381/106 |
| 5,140,283 | 8/1992 | Reed | 330/284 |
| 5,201,009 | 4/1993 | Yamada et al. | 381/104 |

*Primary Examiner*—Curtis Kuntz
*Assistant Examiner*—Huyen D. Le
*Attorney, Agent, or Firm*—McAndrews, Held & Malloy, Ltd.

[57] ABSTRACT

A hearing aid houses an integrated circuit having at least one programmable resistor for setting the audio response of the hearing aid. The programmable resistor has at least 14 discrete steps of programmed resistance. In a first embodiment of the programmed resistor, the difference in programmed resistance between successive steps changes logarithmically and a second embodiment has the difference in programmed resistance between successive steps changing logarithmically for the higher values of programmed resistance and changing linearly for the lower values of programmed resistance. The programmable resistor is connected between two terminals and comprises at least seven subcircuits. Each subcircuit comprises a resistor and a switch sharing a common node, the first of the subcircuits has one end connected to the first terminal. A second subcircuit is connected between the common node of the first subcircuit and the second terminal and the common node of the second subcircuit is connected to the other end of the first subcircuit. A third subcircuit is connected between the common node of the second subcircuit and the second terminal. There are four or more other subcircuits which are each connected between the first and the second terminals. A decoder circuit receives a control word and decodes the control word into set of control bits, each control bit connected to each of the switches.

20 Claims, 6 Drawing Sheets

HEARING AID WITH PROGRAMMABLE RESISTOR

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

The present invention relates to a hearing aid, and more particularly, to a hearing aid having a programmable resistor which is programmed by a programming system external to the hearing aid.

Hearing aids having programmable resistances are known. Such resistors have a range of resistances and are part of circuits in the hearing aid which adjust input-output (I/O) characteristics of wide dynamic range compressors such as the compression ratio and the lower and upper values of sound pressure level (SPL) at which compressor action begins or ends (commonly referred to as the lower and upper threshold knee, respectively), which set the input-output characteristics of output-limiting compressors (typically the SPL at which limiting sets in), and which operate as tone controls to control the frequency response (most often the low frequency response with action similar to the treble and bass controls on a stereo set). Almost all hearing aids have adjustments for at least one of these characteristics, and more advanced hearing aids have need for four or more adjustments. In general, each of the adjustable characteristics are set for the wearer of the hearing aid by changing a resistance, usually accomplished by manually adjusting trimmers (rheostats) on the faceplate of the hearing aid. The faceplate becomes undesirably large as the number of electrically adjustable characteristics, and their attendant trimmers, is increased. In order to allow the hearing aid to have multiple electrically adjustable characteristics but to reduce or maintain the size of the faceplate, hearing aids with programmable resistances were developed. Before or during fitting of the hearing aid, an external programmer sends a control word through a port on the hearing aid to a set of programmable resistors on an integrated circuit within the hearing aid. One programmer employs three wires to program the programmable resistor to the desired resistance. The first and second wires supply a programming code and a clock signal to clock the programming code into the memory and the third wire supplies the programming voltage to the memory. Another programmer in development uses a single wire which permits several operations: 1) synchronize the clock in the programmer to the on-chip clock in the programmable resistor, 2) read the existing on-chip data stored in the on-chip non-volatile memory, 3) send new data to the chip where it is initially stored in volatile memory, and 4) provide the programming voltage (typically 10–20 volts at the present time) needed to transfer the new data to the non-volatile on-chip memory.

Each programmable resistor changes one of the electrically adjustable characteristics of the hearing aid. There are two general types of programmable resistors: one having a parallel network of resistor (FIG. 1A) and one having a series network of resistor (FIG. 1B). In either structure, a switch is combined with each resistor to either switch the resistor into the circuit so current flows through the resistor, or to shunt the current around the resistor so current flows through the switch instead of the resistor. In the case of the parallel network, the switch is in series with the resistor so that when the switch is activated, current flows through the switched-in resistor. In the series network, the switch is electrically in parallel with the resistor, so that when the switch is activated, current shunts around the resistor instead of flowing through the resistor. As several of these programmable resistors may be on the same integrated circuit, it is desirable to reduce the space that each programmable resistor occupies. Both the resistors and the switches contribute to the overall size of the programmable resistor. A resistor occupies a specific amount of space depending on the resistivity of material used and the length to width ratio of the resistor. The resistance of a resistor is given by:

$$R = \rho \frac{L}{A}$$

The resistivity of a standard SiCr resistor material typically used in the hearing aid industry, is approximately 2000 ohms per square. On the other hand, switch size is a function of the resistance to be switched. In general, a switch should have an on-resistance of less than 20% of the resistance it switches into or out of the circuit. The on-resistance of a MOS switch is given by:

where K is a material constant, $V_{GS}$ and $V_T$ are the gate to source voltage and the threshold $$R_{ON} = \frac{L}{KW(V_{GS} - V_T)}$$

voltage of the MOS device, respectively, and where L and W are the length and width of the channel of the MOS device. The size of the switch is a function of its length to width ratio.

Parallel resistor networks, such as the one shown in FIG. 1A, are well-suited for low valued programmable resistors, since the size contribution from the switches rather than the resistors dominates the overall size of the programmable resistor and because each resistor has a resistance necessarily larger than the overall programmable resistance. On the other hand, series resistor networks, such as the one shown in FIG. 1B, are especially well-suited for high valued programmable resistors, since the size contribution from the resistors dominates the contribution from the switches, and since all the resistors have a resistance necessarily less than the total programmable resistance.

A logarithmic programmable resistor, which is desirably used in hearing aids, has programmed resistances which progress in proportional relationship to $\log_{10}x$. For example, a programmed minimum resistance of 1 k ohm might increase by a factor of 1.41 k ohm with each step in resistance, up to a maximum value of 100 k ohm or higher. For this example, the progression of programmable resistances would be 1 k ohm, 1.41 k ohm, 2.0 k ohm, 2.82 k ohm, 4.0 k ohm, etc. When the required accuracy of a logarithmically programmable resistor is high, many step sizes are required and large numbers of resistors and switches must be used to achieve the desired values. A control word which controls the switches must have as many bits as there are switches in the programmable resistor. For example, a 9 bit wide switch control word defines up to $2^9$ (512) various resistance values, while a 7 bit wide switch control word defines up to $2^7$ (128) various resistance values. It is easier to achieve a typical accuracy of 10% in each programmable resistance when there are 512 possible combinations of the resistances than when there are 128 possible combinations. In general, as the number of switches (and attendant resistors) decreases in a programmable resistor, the relative accuracy of the lower values of programmed resistance is compromised, since relative accuracy is an expressed percentage of the desired programmed resistance and because the number of low valued resistors is typically small (since the low valued resistors are undesirably large and require a companion large switch).

Furthermore, as each switch in either a series or a parallel programmable resistor network is controlled by a control signal, the complexity of the circuitry needed to provide the control signals to the switches is significant when the number of switches is large. Logarithmically programmable resistors typically have large numbers of low on resistance switches and large numbers of high resistance valued resistors, both of which factors contribute to a large physical size and the potential for excessive power consumption. Physical size is critical in that it limits the number of resistors which can be used in the smallest hearing aids and also affects the cost of the programmable resistor circuit. These programmable resistors also must necessarily provide a control signal to each of the switches, leading to undesirably complex control signal circuits.

There is thus a need for a hearing aid with a high accuracy programmable resistor programmed by a reduced number of control bits and having a wide range of logarithmically related programmed resistances, but which reduces the amount of integrated circuit area.

SUMMARY OF THE INVENTION

A hearing aid houses an integrated circuit having at least one programmable resistor for setting the audio response of the hearing aid. The programmable resistor has at least 14 discrete steps of programmed resistance. In a first embodiment of the programmed resistor, the difference in programmed resistance between successive steps changes logarithmically and a second embodiment has the difference in programmed resistance between sucessive steps changing logarithmically for the higher values of programmed resistance and changing linearly for the lower values of programmed resistance. The programmable resistor is connected between two terminals and comprises at least seven subcircuits. Each subcircuit comprises a resistor and a switch sharing a common node, the first of the subcircuits has one end connected to the first terminal. A second subcircuit is connected between the common node of the first subcircuit and the second terminal and the common node of the second subcircuit is connected to the other end of the first subcircuit. A third subcircuit is connected between the common node of the second subcircuit and the second terminal. There are four or more other subcircuits which are each connected between the first and the second terminals. A decoder circuit receives a four bit control word from an external programmer and decodes the control word into set of control bits, each control bit connected to each of the switches, where each resistor corresponds to the difference in programmed resistance between two successive steps. The resistor and the switch in each of the seven subcircuits have a value of resistance, where the resistance of the switch is approximately one-fifth the resistance of the resistor.

TABLE 1 shows the values of resistors in programmable resistors 104, 106, and 108;

TABLE 2 shows the values of resistors in programmable resistor 102;

TABLE 3 shows the values of resistors in programmable resistor 110;

TABLE 4 shows the values of resistors in programmable resistor 112; and

Figure 6:
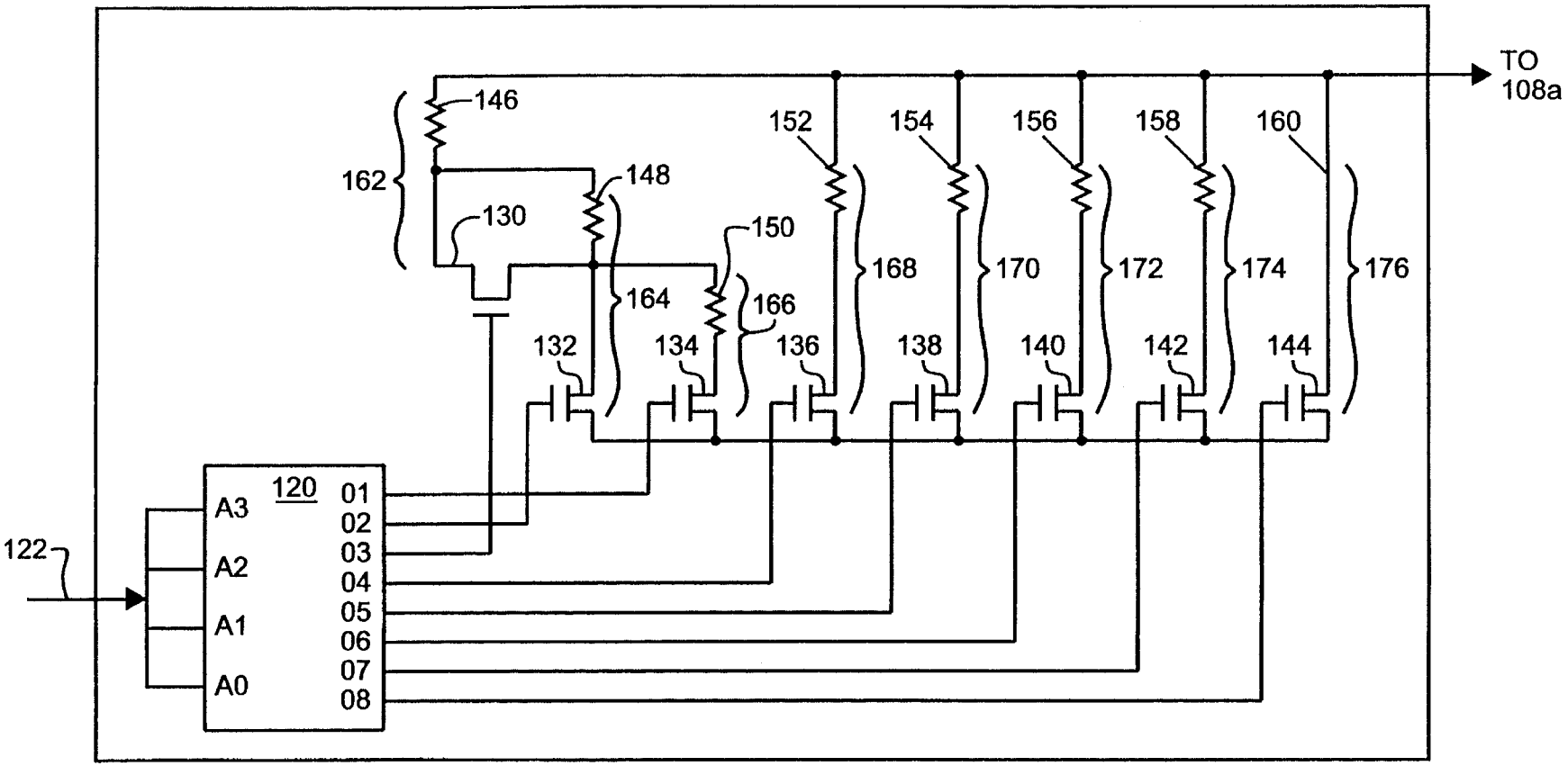
FIG. 6 is a preferred embodiment of a programmable resistor circuit of the present invention.

TABLE 5 shows the truth table for the decoder shown in FIG. 6.

DETAILED DESCRIPTION OF THE PREFERRED EMBODIMENTS

Figure 2:
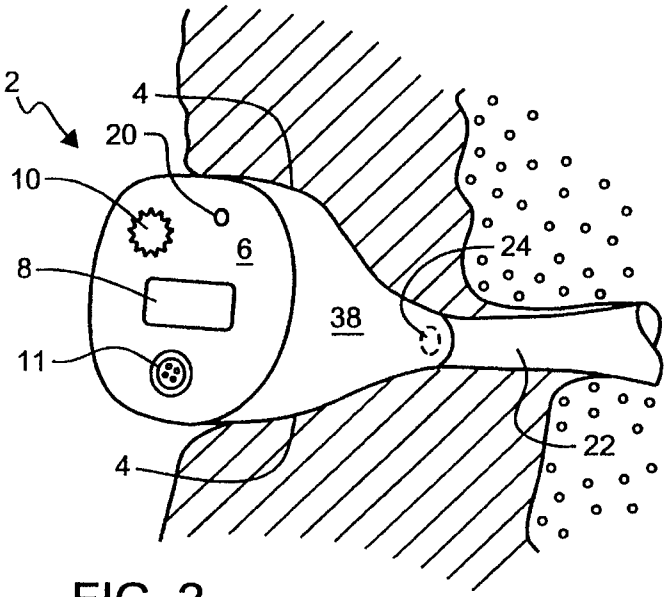
FIG. 2 is a sketch of a hearing aid of the present invention shown in an ear canal.

In FIG. 2, a hearing aid of the present invention shown generally at 2 fits into an ear canal 4. Hearing aid 2 has a housing 38 and is oriented in ear canal 4 so that a faceplate 6 is accessible to audio signals from the environment. Faceplate 6 includes several user-accessible features: a battery cover 8, a volume control 10 and a programming connector 11, for programming the programmable resistors of the present invention. Audio signals enter hearing aid 2 at an entry port 20 and after amplification and filtering, exit into auditory canal 22 through hearing aid output 24 (dotted line).

Figure 1B:
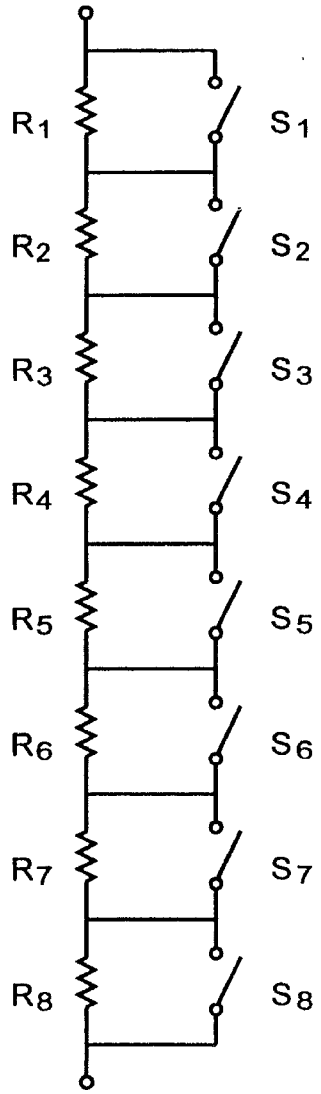
FIG. 1B PRIOR ART
FIGS. 1A and 1B are prior art schematics of a parallel and series programmable resistor networks circuits, respectively.
Figure 1A:
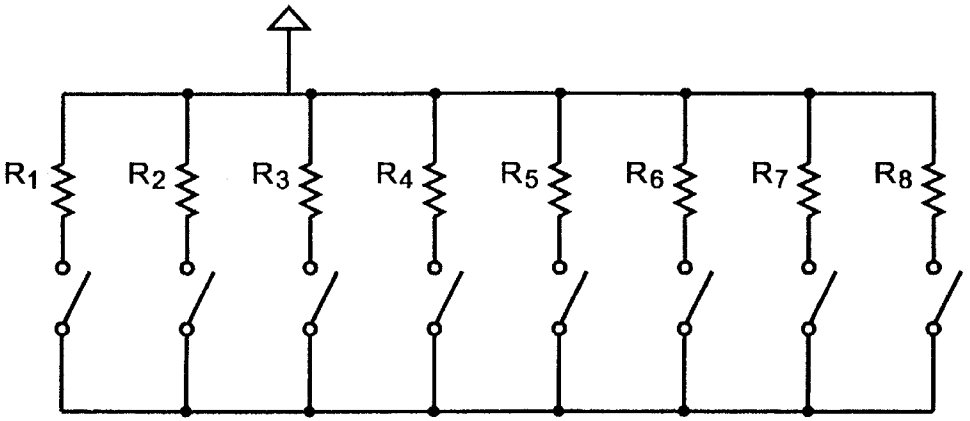
FIG. 1A PRIOR ART
Figure 3:
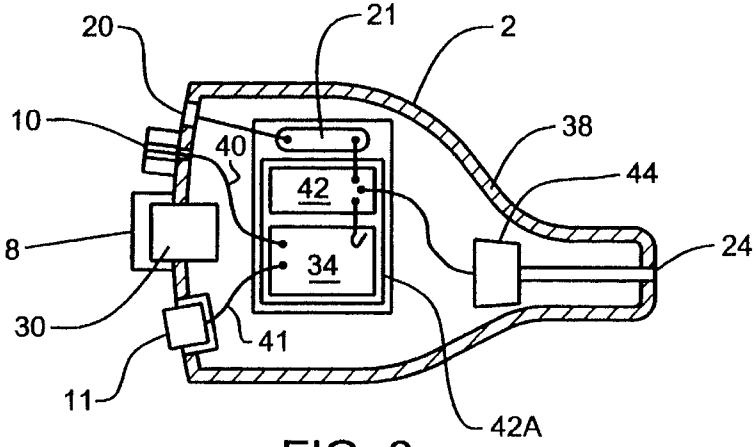
FIG. 3 is a section and part electrical schematic of the hearing aid shown in FIG. 2B.

In FIG. 3, hearing aid 2 is sectioned to show electrical connections inside housing 38. Audio signals enter sound inlet 20 on faceplate 6, are transduced into electrical signals representative of the sound by microphone 21, and are amplified in an amplifier circuit 42. Amplifier circuit 42 is preferably a K-Amp amplifier circuit supplied by Etymotic Research, and is affixed to the same hybrid circuit 42A to which a Programmable Resistor Integrated Circuit 34 (PRIC) is affixed. Microphone 21 and hybrid 42A are typically installed on a common circuit board within housing 38, which receives its operating power from a battery 30 under battery cover 8. In actual use, all the circuitry in hearing aid 2 operates from power supplied from battery 30 so it is desirable to minimize the power consumed by each circuit in the hearing aid. Circuit 42 is electrically connected to volume control 10 via connection 40. Circuit 34 is connected to programming connector 11 via bus 41 and to amplifier 42 via internal connections on hybrid 42A. Circuit 34 includes a set of logarithmically and linearly programmable resistors of the present invention, which control K-Amp amplifier 42 and filter characteristics of amplifier 42 to provide an improved output. The improved output from circuit 42 is connected to an earphone 44 and output through exit port 24 in hearing aid 2.

Figure 4:
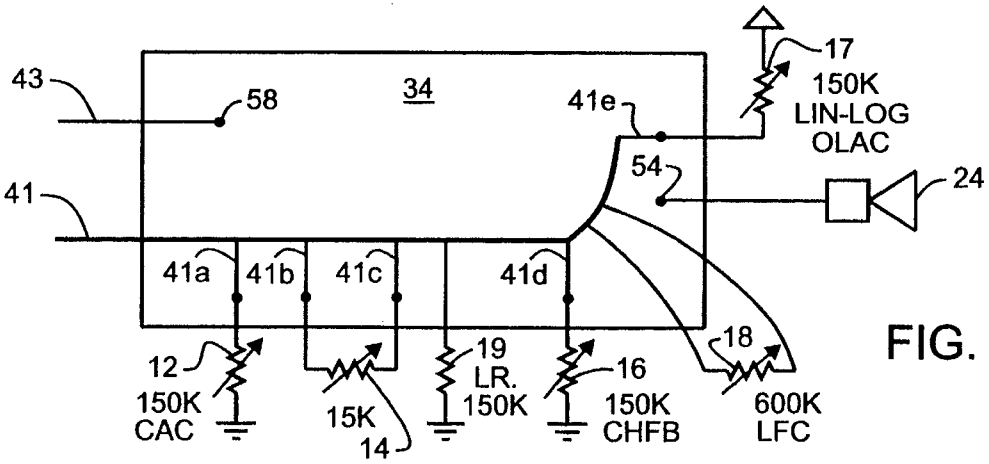
FIG. 4 is an electrical schematic of the programmable resistor integrated circuit shown in FIG. 3.
Figure 4A:
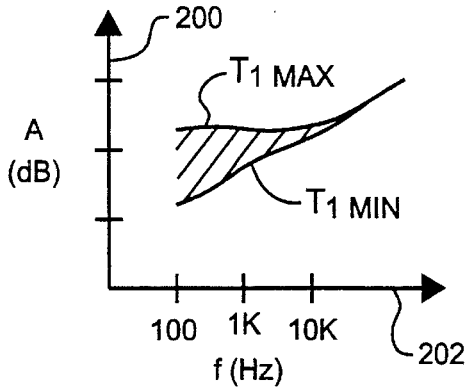
FIGS. 4A–4B are plots of the audio response in dB versus frequency, as a function of programmable resistance.
Figure 4B:
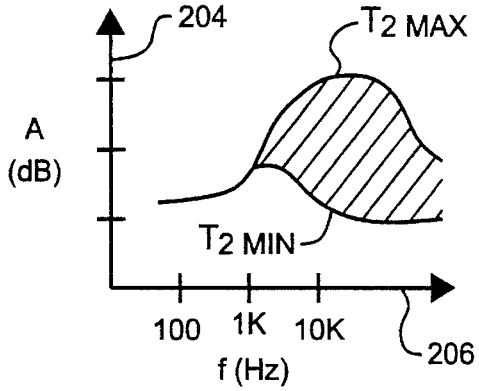
Figure 4C:
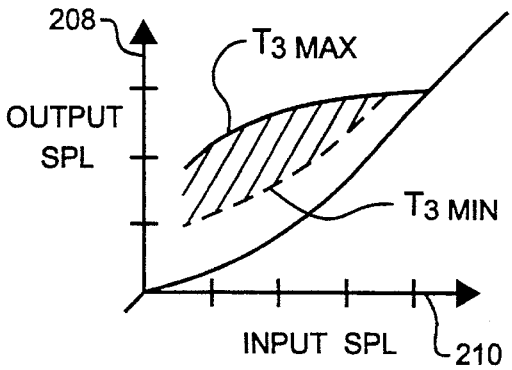
FIGS. 4C–4F are plots of the output SPL v. input SPL of the hearing aid, as a function of programmable resistance.
Figure 4D:
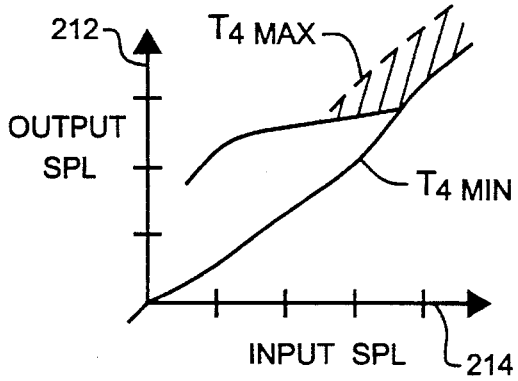
Figure 4E:
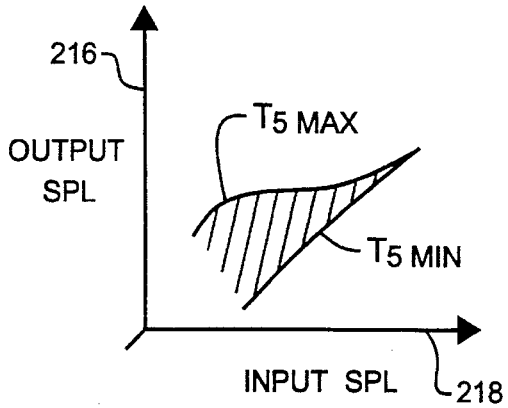
Figure 4F:
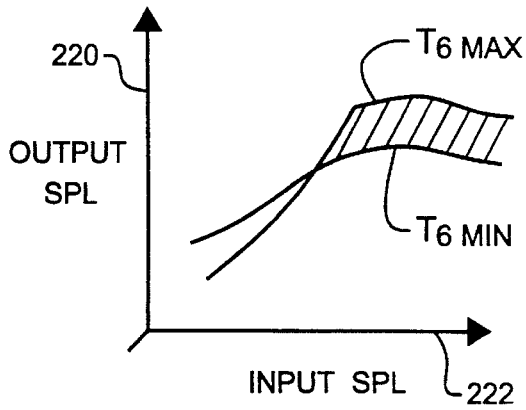

FIG. 4 shows a modified electrical schematic of PRIC 34, specifically showing programmable resistors 12–19 connected via bus 41 to programming connector 11. Programmable resistor 18 has a range of resistance values between $T_{1MAX}$ and $T_{1MIN}$, and changing its programmed resistance changes the low frequency tone control. In particular, FIG. 4A plots the gain, A, of hearing aid 4 on an axis 200 versus frequency on an axis 202 and shows how adjustments of resistor 18 affect the low frequency response. Programmable resistor 16 has a range of resistance values between $T_{2MAX}$ and $T_{2MIN}$. FIG. 4B plots the gain, A, of hearing aid 4 on an axis 204 versus frequency on an axis 206 and shows how adjustments of potentiometer 16 affect the high frequency response. In like fashion, FIG. 4C shows how adjustments of potentiometer 14, over a range of values bounded by $T_{3MIN}$ and $T_{3MAX}$, affect the lower threshold knee of compression. FIG. 4C shows the output SPL on an axis 208 and input SPL on an axis 210. FIG. 4D shows how adjustments of potentiometer 19, over a range of values bounded by $T_{4MIN}$ and $T_{4MAX}$, affect the upper threshold knee of compression. FIG. 4D plots the output SPL on an axis 212 and input SPL on an axis 214. FIG. 4E shows the operation of compression ratio control, as shown when programmable resistor 12 takes on programmed resistance values between $T_{5MIN}$ and $T_{5MAX}$. Compression ratio control is defined as the ratio of difference between two input SPLs and the difference between the corresponding output SPLs. The ratio of output SPL is plotted on an axis 216 and the ratio of output SPL is plotted on an axis 218. FIG. 4F shows the effect of the output compression limiting control, as when programmable resistor 17 takes on values between $T_{6MIN}$ and $T_{6MAX}$. Compression limiting control 16 affects the output SPL at which limiting occurs (i.e. the SPL above which increases in input cause substantially no change in output).

Figure 5:
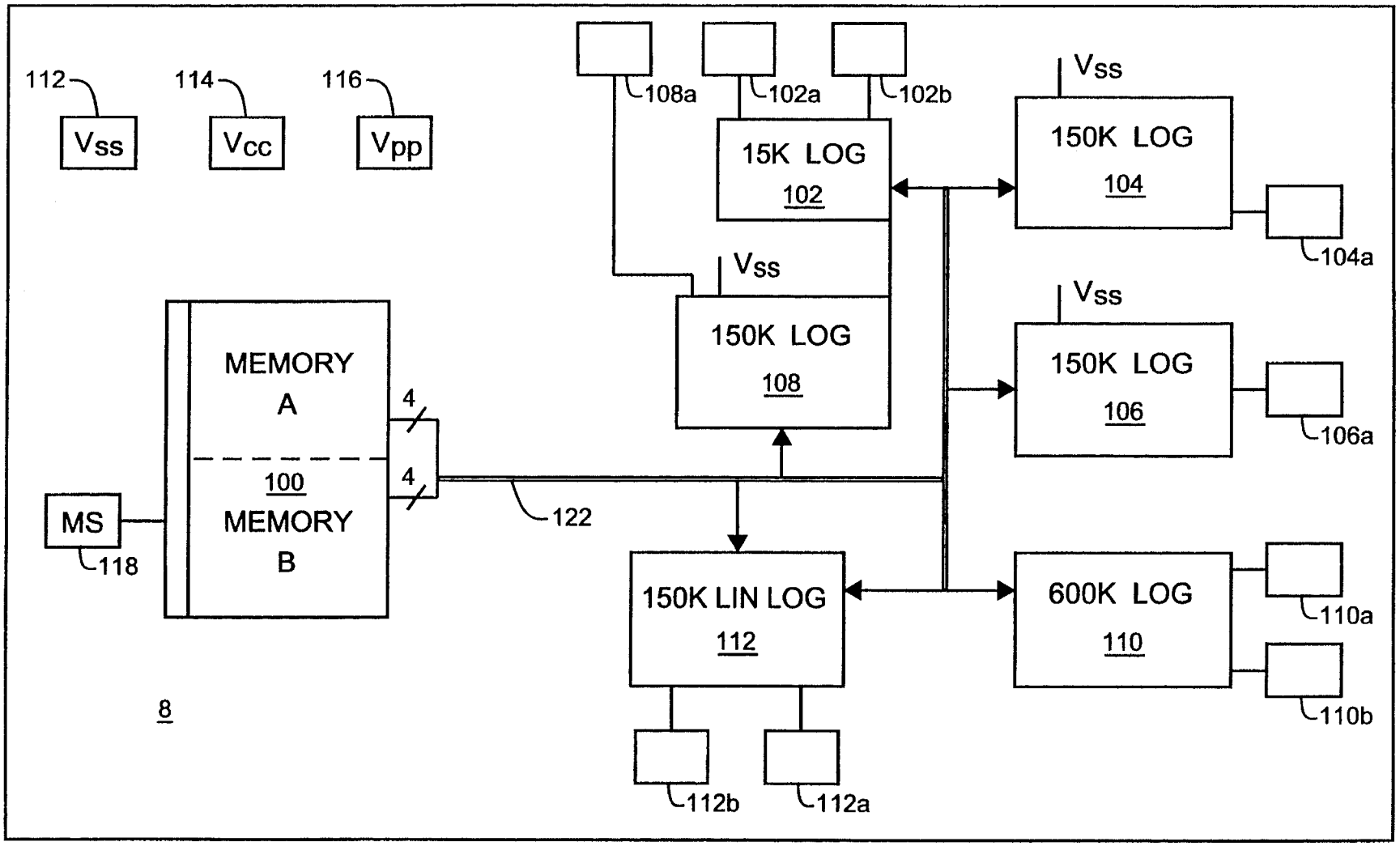
FIG. 5 is a schematic of a programmable resistor integrated circuit of the present invention.

In FIG. 5, circuit 34 includes an EEPROM memory 100 partitioned into separate sections A and B to store 4 bit codes for controlling switches in a 15 k log resistor 102, three 150 k log resistors 104, 106 and 108, a 600 k log resistor 110 and a 150 k linear logarithmic resistor 112. Memory 100 is preferably electrically erasable programmable read only memory (EEPROM), or some other non-volatile memory so as to conserve operating power for hearing aid 4. Integrated circuit 34 is preferably manufactured using basic MOS processing methods but which includes a SiCr resistor manufacturing step. For stability and accuracy, it is preferred that resistive material in resistors 102–112 is of SiCr and approximately 2000 ohms per square.

Programmable resistor 102 is connected between pads 102*a* and 102*b*. Similarly, the pads for each of the other programmable resistors have the same reference designator numbers as the programmable resistor, followed by an a and/or b, as appropriate. When there is only one pad shown on a resistor, the connection omitted from the drawing is connected to $V_{SS}$. Power for programmable resistor integrated circuit 34 is received at pads 112–114, labelled $V_{SS}$, $V_{CC}$ respectively, and connected to battery 30. Programming functions are performed through pad $V_{PP}$. Memory select pad 118 selects memory A when a high voltage level is present on pad 118 and selects memory B when a low voltage value is present on pad 118. After circuit 34 is installed in hearing aid 2, memory 100 may be programmed by hearing aid programming systems such as a revised Qualitone® programming board, a Starkey Pro-Connect system or a European Hi-Pro system with suitable software, or such system as is commonly known in the hearing aid industry.

FIG. 6 shows a resistor network realizing one of 150 k logarithmic resistors 104, 106 and 108. A bus 122 carries a 4 bit code from memory 100, which is representative of a control word required to selectively activate a set of MOS switches 130–144. A decoder 120 receives the code and decodes it into an appropriate 8 bit switch command word for controlling the gates of FET switches 130–144. Any decoding circuit, such as a ROM, can be used to realize the function of decoder circuit 120. Switch 130 and a resistor 146 define a first resistor subcircuit 162. Switch 132 and a resistor 148 define a second resistor subcircuit 164. Switch 134 and a resistor 150 defines a third subcircuit 166. In a like fashion, resistors 152–158 combine with switches 136–142 to form fourth, fifth, sixth, and seventh respective subcircuits 168–174. Switch sizes should be selected as a function of the length to width ratio of the switch so that the switch has approximately one-fifth (20%) of the resistance of the resistor in the same subcircuit. Switch 144 alone comprises subcircuit 176. When switch 144 is activated, the resistor network performs the function of a switch, providing a low-resistance condition between its terminals. Activating all the switches will further loweeer the overall resistance, permitting switch 144 to be smaller than it would otherwise need to be to achieve the desired switch reistance of less than 200 ohms. All switch activated is illustrated in Table 5 by the binary condition 0000 (all switches closed). With all switches open (binary condition 1111 in Table 5), on the other hand, the resistor network presents an open circuit between its terminals. Thus the resistor network performs a dual duty as switch and/or as resistor, depending on what is needed in a given hearing aid design.

Resistors 162–166 are part of series resistor subcircuits because the resistor in each of the subcircuits is not connected across the terminals of programmable resistors 108 when the switch in the subcircuit is activated. Resistors 168–176 are part of parallel subcircuits because the resistor in each of the subcircuits is connected in parallel across the terminals of resistor 108 when the switch in the subcircuit is activated. Resistors 146–160 have resistance values as given in TABLE 1 for the 150 k logarithmically programmable resistor. The resistance values in all the TABLES are given in units of ohms.

TABLE 1

| Resistor Value | Nominal Resistance Value | Switch Number |
|---|---|---|
| 146 | 49.5k | 130 |
| 148 | 72.0k | 132 |
| 150 | 28.5k | 134 |
| 152 | 33.0k | 136 |
| 154 | 13.5k | 138 |
| 156 | 5.0k | 140 |
| 158 | 2.85k | 142 |
| 160 | 0.0k | 144 |

Decoder circuit 120 in FIG. 6 can be implemented in Boolean NAND/NOR gates or in a ROM. A truth table for decoder 120 is shown in TABLE 5, where the decoder input (i.e. the memory code word) A3-A0 and the corresponding decoder 120 outputs O0-O8 (i.e. the switch control word) is given below:

TABLE 5

| AAAA 3210 | OOOOOOOO 12345678 | |
|---|---|---|
| 0000 | 11111111 | (SHORT) |
| 0001 | 01111110 | |
| 0010 | 00000110 | |
| 0011 | 00000010 | |
| 0100 | 00001100 | |
| 0101 | 00000100 | |
| 0110 | 11011000 | |
| 0111 | 00001000 | |
| 1000 | 11110000 | |
| 1001 | 11010000 | |
| 1010 | 00010000 | |
| 1011 | 11100000 | |
| 1100 | 10100000 | |
| 1101 | 11000000 | |
| 1110 | 10000000 | |
| 1111 | 00000000 | (OPEN CIRCUIT) |

The 15 k ohm logarithmic resistor 102, the 600 k ohm logarithmic resistor 110 and the 150 k ohm linear logarithmic resistor 112 have the same structure of a programmable resistor of the present invention as shown in FIG. 6; only the values of the resistors in the resistor subcircuits and the size of the switches are changed. The truth table, and so the circuitry, for each of the other resistors is as given in TABLE 5. TABLE 2 shows the values of the resistors in the resistor subcircuits and the corresponding switches in the 15 k resistor 102, while TABLE 3 and 4 show the value of the resistors in the subcircuits and size of the switches in resistors 110 and 112 (600 k and 150 k), respectively.

TABLE 2

| Resistor Value | Nominal Resistance Value | Switch Number |
|---|---|---|
| 146 | 4.95k | 130 |
| 148 | 7.2k | 132 |
| 150 | 2.85k | 134 |
| 152 | 3.3k | 136 |
| 154 | 1.35k | 138 |
| 156 | 600 | 140 |
| 158 | 285 | 142 |
| 160 | 0 | 144 |

TABLE 3

| Resistor Value | Nominal Resistance Value | Switch Number |
|---|---|---|
| 146 | 198k | 130 |
| 148 | 288k | 132 |
| 150 | 114k | 134 |
| 152 | 132k | 136 |
| 154 | 54k | 138 |
| 156 | 24k | 140 |
| 158 | 11.4k | 142 |
| 160 | 0 | 144 |

TABLE 4

| Resistor Value | Nominal Resistance Value | Switch Number |
|---|---|---|
| 146 | | 130 |
| 148 | | 132 |
| 150 | | 134 |
| 152 | | 136 |
| 154 | | 138 |

TABLE 4-continued

| Resistor Value | Nominal Resistance Value | Switch Number |
|---|---|---|
| 156 | | 140 |
| 158 | | 142 |
| 160 | | 144 |

A preferred process for the resistors in integrated circuit 34 is a SiCr MOS process where the resistivity of the SiCr resistor material is approximately 2000 ohms per square. In such a commercially available process, a switch length to width ratio of approximately 50–100 is approximately the same size as a 10 k ohm resistor.

Figure 7A:
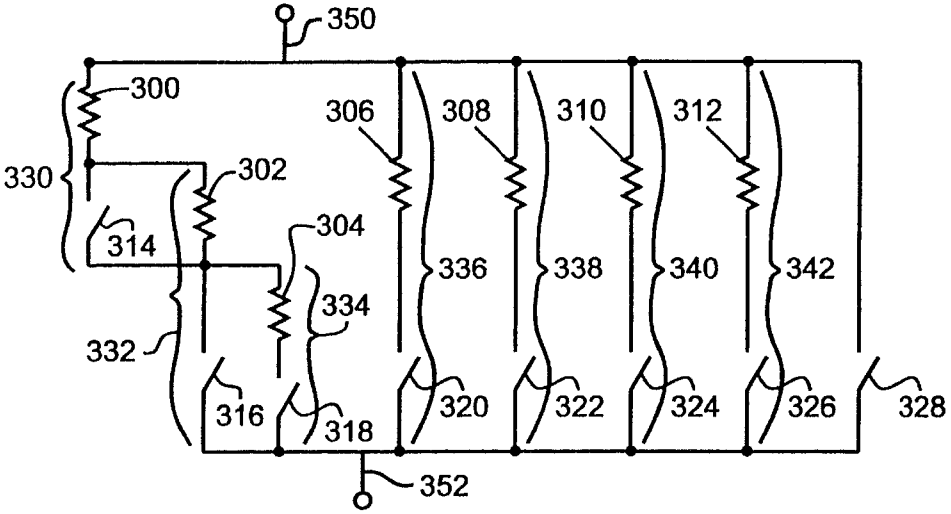
FIG. 7A is a schematic of the present invention, implemented in a 100 k ohm resistor.
Figure 7B:
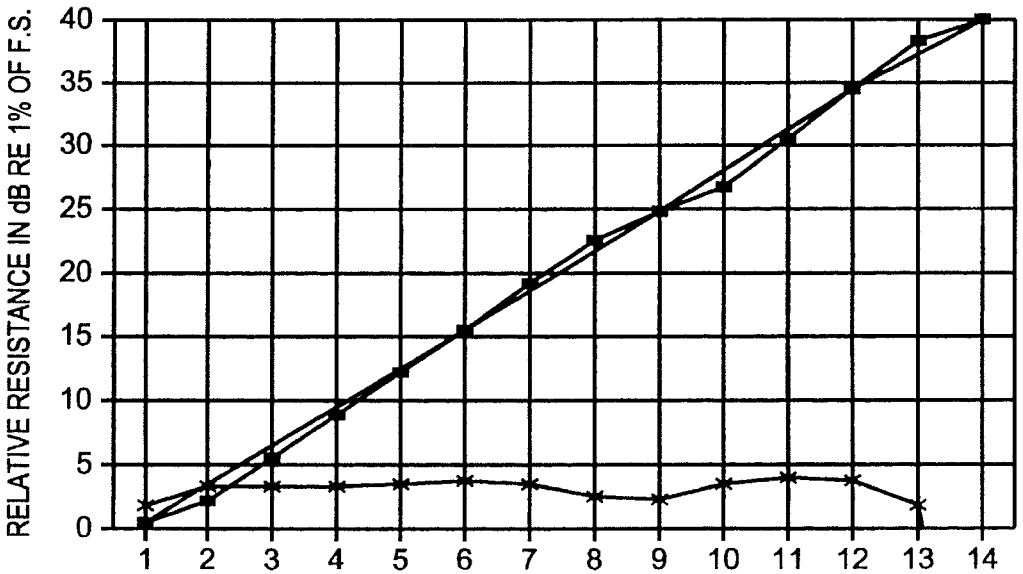
FIG. 7B is a plot of the programmed resistances at each of 14 of 16 programmed resistances, including the error, for a 100 k ohm programmable resistor.

In general, a good first approximation of resistor values can be made by selecting resistor values according to several general guidelines. In practice, the resistor values can be modified somewhat from the first approximation, depending on the desired accuracy. A spreadsheet program is helpful when modifying resistor values from their initial values, so that accuracy of the programmable resistor at each of its programmed steps can be quickly calculated and the user can easily assess whether the resistor values selected meet the required accuracies. FIG. 7B shows the programmed resistances at each of the 14 programmed resistance steps for a 100 k ohm resistor. For a programmable resistor programmed by a four bit control word, there are 16 possible values of programmed resistance. All resistors typically use one of the programmed values as a short (substantially zero ohms) and one programmed value as an open (substantially infinite impedance), leaving 14 programmed values distributed appropriately over the span of the resistor. For the logarithmic programmable resistor shown, the 100 k span represents 40 dB and the differences between each successive programmed resistance is 40 dB divided by 14, or 3.1 dB. Some programmable resistors have logarithmic differences in programmed resistance over a first range and linear differences over a second range and some have successive programmed resistances which are linearly related. The guidelines presented below apply equally well to all these types of programmable resistors. I have found that it is preferable to have a programmable resistor programmed by a four bit control word, and to have at least three series resistor subcircuits, and at least four parallel resistor subcircuits, where the values of the resistors in each of the subcircuits are preferably selected according to the guidelines.

The general procedure for choosing resistances can be explained as follows. The resistances in each of the series resistor subcircuits 300–304 should sum to the total desired programmable resistance. When steps of 3.1 dB are desired, as in the present example, the resistance at each succeeding step should be 0.7 times the resistance of the preceeding step. For example, in the 100 k ohm logarithmic resistor shown in FIG. 7A, series resistors 300–304 have resistances of 33 k ohms, 48 k ohms and 19 k ohms, respectively, which when summed together equals the total programmed resistance of 100 k ohms. The value of resistor 300, which is the minimum calue the combined series subcircuits can have, should be approximately one-third of the total resistance of 100 k ohms obtained at step #14 in the graph of FIG. 7B. With this value, the desired resistance for step #11 of nominally 34 k ohms (0.7*0.7*0.7=0.34) is approximated. The values of resistors 302 and 304 are then apportioned to best approximate 3.1 dB steps, so that when switch 314 is closed the sum of resistors 304 and 300 will be slightly less than half of the total value of 100 k ohms in order to mmet the goal of 49 k ohms (0.7*0.7=0.49) for step #12. Choosing values of 33 k ohms and 49 k ohms for resistors 300 and 302, respectively, leaves 17 k ohms for resistor 304. A slightly better logarithmic linearity for those steps is obtained with values of 33 k ohms, 48 k ohms and 19 k ohms, respectively, which values also cooperate with resistors 152–159 to provide the desired resistance for the succeedingly lower steps.

In a similar manner, the resistances of the parallel resistor subcircuits can be chosen. Resistor 306 is chosen so that by itself it approximates the value required for step #10 of 24 k ohms (0.7*4=0.24). Steps #9 and #8 are obtained by adding in parallel appropriate values of resistance from the series network just discussed. Resistor 308 is chosen so that by itself it approximates the resistance requires at step #7 (0.7*8=0.72). The resistance at step #6 is obtained by paralleling resistor 308 with resistor 306 and with resistance from the series network. Once these basic choices are made, desirable modification to the values of individual resistors in order to improve overall linearity become self-evident as the spreadsheet graph shows overall performance. In a like manner, resistors 310 and 312 are chosen to approximate the resistance requires at step #5 and step #3, respectively. Once chosen, the resistances at in-between steps are obtained by combinations of the preceeding resistors, as described above. The parallel combination of all available resistors 300 and 306–312 provides the lowest resistance step set by design equal to approcimately 1% of the total resistance.

The other subcircuits 336–342 are parallel subcircuits, each with resistor values less than resistor values in series subcircuits 330–334. The parallel subcircuits 336–342 have switches with length to width ratios which define a switch occupying more space than the space occupied by the resistor (e.g. 306–312) in the same subcircuit. It is preferable that resistor values between 10 k to 100 k have approximately the same physical size as the size of switches in the same subcircuit and that those subcircuits are parallel subcircuits. Should the integrated circuit manufacturing process be modified, parallel subcircuits should comprise switches with approximately the same or a larger physical size than the corresponding resistor in the parallel subcircuit. Over the programmed resistance steps corresponding to parallel subcircuits (e.g. step 10 and lower), there is more freedom to select which of the other switches in the When resistor subcircuits have resistor values selected according to the guidelines, and switches in the parallel subcircuits are chosen as described above, the sum of the area of all the switches is approximately equal to the area of the largest resistor, thereby conserving space and attendant power consumption. The present invention minimizes the overall cumulative area for both switches and for resistors while providing approximately less than 5% accuracy of each of the programmable resistances with only a four bit control word.

Change can be made to the circuit disclosed herein without departing from the scope and spirit of the present invention. For example, additional series and parallel subcircuits can be included in the structure of a programmable resistor of the present invention, but then the control circuitry will be somewhat more complicated. Specifically, the guideline that teaches that each single resistor value corresponds to an adjacent difference in programmed resistance will be obviated, in order to provide more accuracy. Although the present invention has been described with reference to preferred embodiments, workers skilled in the art will recognize that changes may be made in form and detail without departing from the spirit and scope of the invention.

What is claimed is:

1. A programmable resistor connected between a first and a second terminal, the programmable resistor receiving a control word from an external programmer, the resistor having a series of programmable resistance steps, the resistor comprising:

a first series subcircuit comprising a resistor and a switch sharing a common node, the first subcircuit having one end connected to the first terminal;

second and third series subcircuits, each comprising a resistor and a switch sharing a common node, the second series subcircuit connected between the common node of the first subcircuit and the second terminal, the common node of the second subcircuit connected to the other end of the first subcircuit, the third subcircuit connected between the common node of the second subcircuit and the second terminal;

four parallel subcircuits, each comprising a resistor and a switch, each connected between the first and the second terminals; and a decoder circuit for receiving the control word and for decoding the word into a set of control bits, each control bit connected to one of the switches, where each resistor corresponds to a difference in programmed resistance between two successive resistance steps.

2. The programmable resistor of claim 1 where the resistor and the switch in each subcircuit have a resistance, and the resistance of the switch is less than one-fifth the resistance of the resistor.

3. The programmable resistor of claim 1 where the resistors are made of a thin film material.

4. The programmable resistor of claim 3 where the thin film material comprises silicon and chromium.

5. The programmable resistor of claim 1 where the switches are FETs.

6. The programmable resistor of claim 1 where the values of the resistors in the series subcircuits sum to the total resistance of the resistor.

7. The programmable resistor of claim 1 where the values of the resistors in the series subcircuits sum to 100 k ohms.

8. The programmable resistor of claim 1 where the values of the resistors in the series subcircuits sum to 150 k ohms.

9. The programmable resistor of claim 8 where there are 14 programmed steps of resistance, and the programmed resistances change logarithmically for at least the three largest steps of programmed resistances and changes linearly for at least the three smallest steps of programmed resistance.

10. The programmable resistor of claim 1 where the values of the resistors in the series subcircuits sum to 2M ohms.

11. The programmable resistor of claim 1 where the values of the resistors in the series subcircuits sum to 200 k ohms.

12. The programmable resistor of claim 1 where the values of the resistors in the series subcircuits sum to 15 k ohms.

13. The programmable resistor of claim 1 where a first of the resistance steps corresponds to having all the switches activated and a last of the steps corresponds to having all the switches unactivated.

14. The programmable resistor of claim 13 where there are 16 steps of resistance.

15. The programmable resistor of claim 1 where the value of the resistors in the series subcircuits sum to 600 k ohms.

16. A hearing aid, comprising:

a housing;

a memory for storing a set of codes; and at least one programmable resistor, the programmable resistor connected between a first and a second terminal, the programmable resistor having a set of programmed resistance steps and comprising at least seven subcircuits, each subcircuit comprising a resistor and a switch sharing a common node, each of the subcircuits having a first and a second end, the first of the subcircuits having a first end connected to the first terminal, the second subcircuit connected between the common node of the first subcircuit and the second terminal, the second end of the first subcircuit connected to the common node of the second subcircuit, the third subcircuit connected between the common node of the second subcircuit and the second terminal, the remaining subcircuits each connected between the first and the second terminals;

a decoder circuit for receiving at least a three bit control word and decoding the control word into a set of control bits, each control bit connected to the, where each resistor corresponds to the difference in programmed resistance between two successive steps.

17. The hearing aid of claim 16 where the resistor and the switch in each subcircuit have a resistance, and the resistance of the switch is less than one-fifth the resistance of the resistor.

18. A programmable resistor connected between a first and a second terminal, the programmable resistor having a range of programmable resistances values as a function of a switch control word, the resistor comprising:

three series subcircuits, each series subcircuit having a resistor and a switch joined at a common node, the first series subcircuit having one end connected to the first terminal, the second series subcircuit having one end connected to the common node of the first series subcircuit and the other end connected to the second terminal, the other end of the first series subcircuit connected to the common node of the second series subcircuit, the third series subcircuit having one end connected to the common node of the second series subcircuit and the other end connected to the second terminal, the resistors in each of the series subcircuits having a resistor value, the sum of the series resistor values substantially equal to a largest programmable resistance value in the range;

four parallel subcircuits, each parallel subcircuit having a resistor and a switch joined at a common node, the parallel subcircuits each having one end connected to the first terminal and the other end connected to the second terminal; and a decoder circuit receiving the switch control word and having a plurality of outputs, each output connected to one of the switches, where each resistor in the programmable resistor has a value which substantially corresponds to the difference between two successive programmed resistances.

19. The programmable resistor of claim 18 further comprising a fourth series subcircuit having one end connected the common node of the third series subcircuit and the other end connected to the second terminal.

20. The programmable resistor of claim 19 further comprising a fifth parallel subcircuit having one end connected to the first terminal and the other end connected to the second terminal.

* * * * *

UNITED STATES PATENT AND TRADEMARK OFFICE

CERTIFICATE OF CORRECTION

PATENT NO. : 5,602,925
DATED : February 11, 1997
INVENTOR(S) : Mead C. Killion

It is certified that error appears in the above-identified patent and that said Letters Patent is hereby corrected as shown below:

IN COLUMN 5, LINE 59

Please insert a comma between the words "$V_{cc}$" and "respectively".

IN COLUMN 10, LINE 39

Cancel "sum" and insert --sums-- therefor.

IN COLUMN 10, LINE 43

Cancel "values" and insert --value-- therefor.

IN COLUMN 10, LINE 52

Cancel "values" and insert --value -- therefor.

UNITED STATES PATENT AND TRADEMARK OFFICE

CERTIFICATE OF CORRECTION

PATENT NO. : 5,602,925
DATED : February 11, 1997
INVENTOR(S) : Mead C. Killion

It is certified that error appears in the above-identified patent and that said Letters Patent is hereby corrected as shown below:

IN COLUMN 10, LINE 55

Cancel "values" and insert --values-- therefor.

IN COLUMN 10, LINE 58

Cancel "values" and insert --values-- therefor.

IN COLUMN 11, LINE 23

Cancel "the" and insert --one of the switches--therefor.

Signed and Sealed this

Second Day of December,1997

*Attest:*

Bruce Lehman

BRUCE LEHMAN

*Attesting Officer*

*Commissioner of Patents and Trademarks*